US005669282A

United States Patent [19]

Tanino et al.

[11] Patent Number: 5,669,282

[45] Date of Patent: Sep. 23, 1997

[54] HYDRAULIC CIRCUIT FOR ACTUATING MATERIALS HANDLING MACHINE

[75] Inventors: Masahiro Tanino, Osaka; Manabu Ogo, Itami, both of Japan

[73] Assignee: Sanyo Kiki Kabushiki Kaisha, Okayama-ken, Japan

[21] Appl. No.: 577,109

[22] Filed: Dec. 22, 1995

[51] Int. Cl.[6] ..... F15B 11/22

[52] U.S. Cl. ..... 91/520; 414/700; 414/708

[58] Field of Search ..... 91/176, 178, 520; 414/700, 708

[56] References Cited

U.S. PATENT DOCUMENTS

| | | | |
|---|---|---|---|
| 3,563,137 | 2/1971 | Graber et al. | 91/520 |
| 4,198,822 | 4/1980 | Miller | 91/6 |
| 4,799,851 | 1/1989 | Swanson | 91/532 |
| 5,447,094 | 9/1995 | Geyler | 91/520 |

*Primary Examiner*—F. Daniel Lopez
*Attorney, Agent, or Firm*—Nikaido, Marmelstein, Murray & Oram LLP

[57] ABSTRACT

The hydraulic circuit of the invention includes first and second directional control valves 13, 15, each shiftable between three positions. Hydraulic circuit extending from the second directional control valve 15 and a second cylinder 7 to a first cylinder 11 is so configured that, when the second directional control valve 15 is shifted to the first position, with the first directional control valve 13 being assigned to the N-position, hydraulic oil from the second cylinder 7 is directed to the first cylinder 11, so as to cause the attachment 9 to be tilted in the forward direction, and when the second directional control valve 15 is shifted to the second position, hydraulic oil expelled from the second cylinder 7 is directed to the first cylinder 11, so as to cause the attachment 9 to be tilted in the rearward direction. The hydraulic circuit also includes flow restrictor means 20*a* which restricts a quantity of hydraulic oil flowing from the second cylinder 7 to the first cylinder 11, so that the attachment 9 may kept horizontally at any vertical position of the lift-arm 5. Thus, the lift-arm may be moved up and down, while keeping the attachment at the forward end of the lift-arm horizontally with respect to the ground surface, by actuating only a single directional control valve.

2 Claims, 11 Drawing Sheets

HYDRAULIC CIRCUIT FOR ACTUATING MATERIALS HANDLING MACHINE

FIELD OF THE INVENTION

This invention relates to a hydraulic mechanism for actuating a materials handling machine for use in a front loader of an agricultural tractor or a wheel loader of a construction machine. More particularly, the invention relates to a hydraulic circuit for actuating a materials handling machine that is capable of moving a lift-arm up and down, by only actuating a directional control valve for moving the lift-arm, among two directional control valves for the lift-arm and for an attachment, and capable of keeping various attachments provided at the forward end of the lift-arm at a desired angle with respect to the ground surface.

BACKGROUND OF THE INVENTION

For example, a materials handling machine 31 for use in an agricultural tractor includes, as shown in FIG. 11, a lift-arm 5, with a second cylinder 7 connected to a front portion of a vehicle body 3 for vertical movement, and an attachment 9 of a various type with a first cylinder 11, such as a bucket, connected to the forward portion of the lift-arm 5 for tilting movement in the forward direction or the rearward direction. The materials handling machine also includes, within the vehicle body, a hydraulic circuit for actuating the materials handling machine. The first and second cylinders 11 and 7 are separately controlled by means of a first directional control valve 33 and a second directional control valve 35, each of the directional control valves being shiftable between a N-position (neutral position), and a first position and a second position. Specifically, hydraulic oil from a hydraulic oil supply T is directed through the first directional control valve 33 to the first cylinder 11, so as to cause the attachment 9 to be tilted in the rearward direction when the first directional control valve 33 is assigned tot the first position, and so as to cause the attachment 9 to be tilted in the forward direction when the first directional control valve 33 is assigned to the second position. The hydraulic oil from the hydraulic oil supply is also directed through the second directional control valve 35 to the second cylinder 7 for raising and lowering the lift-arm, so as to cause the lift-arm 5 to be raised or moved vertically when the second directional control valve is assigned to the first position, and so as to cause the lift-arm to be lowered or moved vertically when the second directional control valve is assigned to the second position.

An operator on the vehicle body operates two operating levers 37 and 38 protruding in the operator's seat, so as to separately control the vertical movement of the lift-arm 5 and the tilting movement of the attachment 9, as shown in FIGS. 11 and 12. For example, when the operating levers 37 and 38 are assigned to E1-position and E2-position, respectively, as shown in FIG. 12, the first and second directional control valves are both assigned to the N-position, i.e., neutral position, so that they give no actuation. When he operating lever 37 is shifted to B1-position, the first directional control valve 33 displaced to the right-hand direction, so that the attachment 9 is tilted in the rearward direction. When the operating lever 37 is shifted to H1 position, the first directional control valve 33 is displaced to the left-hand direction, so that the attachment 9 is tilted in the forward direction. When the operating 1ever 38 is shifted to B2 position, the second directional control valve 35 is displaced to the right-hand direction, so as to cause the lift-arm 5 to be raised. When the operating lever 38 is shifted to H2 position, the second directional control valve 35 is displaced to the left-hand direction, so as to cause the lift-arm 5 to be lowered.

It is noted, however, that the hydraulic circuit for actuating a materials handling machine in prior art is problematic, since the first and second directional control valve must be simultaneously operated by means of separate operating levers (two levers). Such operation is tiresome and difficult for operators other than skilled operators. For example, if there is any time difference between the operation timing of the first and second directional control valves, the lift-arm is moved vertically, with the bucket at the forward end thereof being slightly inclined, whereby material, such as compost, disadvantageously falls from the bucket, even if such time difference is very small.

In general, retraction or contraction speed of a hydraulic cylinder is higher than its extension or expansion speed (due to the reduced volume of the cylinder). It is noted, however, that the first cylinder 11 for the attachment requires increased force when it is retracted, since such retraction is frequently needed upon loading operation. It is therefore desired to slightly reduce retraction speed of the first cylinder, so as to increase its power.

On the other hand, extension speed of the first cylinder is slower (due to the increased volume of the cylinder), so that substantial power is not needed, since such extension is frequently required when discharging compost from the bucket. Thus, it is also desired to increase the extension speed of the cylinder, even though its power is reduced to some extent.

It is noted, however, that increased power may be needed when the cylinder is extended so as to raise the front wheels in order to get the vehicle itself out of the mud. Thus, there are contradictive problems to be overcome.

SUMMARY OF THE INVENTION

Under the circumstances, the invention is aimed at a provision of a hydraulic circuit for actuating a materials handling machine that is capable of raising and lowering a lift-arm, while keeping an attachment at the forward end thereof at a substantially constant angle with respect to the ground surface, by only actuating a directional control valve for moving the lift-arm, and not actuating a directional control valve for moving the attachment, and also capable of further increasing speed and power at and by which the first cylinder is extended and retracted.

In order to satisfy the above needs and to achieve the above object, the invention provides a hydraulic circuit for actuating a materials handling machine in which;

hydraulic oil from a hydraulic oil supply is directed, through a first directional control valve shiftable between an N-position (neutral position), and a first position and a second position, to a first cylinder for tilting an attachment, so as to cause the attachment to be tilted to a scooping side or in the rearward direction, when the first directional control valve is assigned to the first position, and so as to cause the attachment to be tilted to a dumping side or in the forward direction, when the first directional control valve is assigned to the second position;

hydraulic oil from the hydraulic oil supply is directed, through a second directional control valve shiftable between an N-position, and a first position and a second position, to a second cylinder for raising and lowering a pivotable lift-arm carrying the attachment at the forward end thereof, so as to raise the lift-arm when the second directional control valve is assigned to the first position, and so as to lower the lift-arm when the second directional control valve is assigned to the second position; characterized by:

with the first directional control valve being assigned to the N-position;

a hydraulic circuit extending from the second directional control valve and the second cylinder to the first cylinder is so configured that, when the second directional control valve is assigned to the first position, hydraulic oil expelled from the second cylinder is supplied to the first cylinder in a manner so as to cause the attachment to be tilted in the forward direction, and that, when the second directional control valve is assigned to the second position, hydraulic oil from the second cylinder is supplied to the first cylinder in a manner so as to cause the attachment to be tilted in the rearward direction;

the hydraulic circuit for actuating a materials handling machine further including:

a hydraulic oil divider/restrictor means for regulating a quantity of hydraulic oil flowing from the second cylinder to the first cylinder, whereby the attachment is kept at a substantially constant angle with respect to the ground surface in accordance with a displacement (variation) in height of the lift-arm.

The hydraulic circuit for actuating a materials handling machine may include a first directional control valve adapted to selectively direct hydraulic oil from the hydraulic oil supply to the N-position (neutral position), the first and second positions, and an additional third position thereof;

with the first directional control valve being assigned to the third position, the hydraulic circuit extending from the second directional control valve and the second cylinder to the first cylinder is so configured that, when the second directional control valve is assigned to the first and second positions, hydraulic oil expelled from the second cylinder is supplied to the first cylinder in a manner so as to cause the attachment to be tilted more quickly in the forward direction.

The hydraulic circuit for actuating a materials handling machine may include a second directional control valve adapted to selectively direct hydraulic oil from the hydraulic oil supply to the N-position (neutral position), the first and second positions, and an additional third position thereof;

with the second directional control valve being assigned to the third position, the hydraulic circuit extending from the second directional control valve and the second cylinder to the first cylinder is so configured that, once the lift-arm has been lowered onto the ground surface, the lift-arm may be moved up and down in accordance with the undulation of the ground surface, and that the inclination angle of the attachment may be varied.

Operation

In accordance with the invention wherein each of the first and second directional control valves is adapted to be shiftable to the additional third position, the vertical movement of the lift-arm and the tilting movement of the attachment may be controlled in nine patterns in total. In particular, when the second directional control valve is assigned to the first position or second position, with the first directional control valve being assigned to the N-position, hydraulic oil is directed from the second cylinder to the first cylinder so as to cause the attachment to be tilted in the forward direction or in the rearward direction. Specifically, hydraulic oil is directed from the second cylinder, through the flow divider/restrictor means, to the first cylinder in a manner so as to cause the attachment to be tilted in the forward direction or rearward direction in accordance with the height of the lift-arm, whereby the attachment may be kept at a substantially constant angle with respect to the ground surface.

When the first directional control valve is provided with a third position and assigned to the third position, additional three control patterns may be used for the vertical movement of the lift-arm and the tilting movement of the attachment. Specifically, when the second directional control valve is assigned to the first position or second position, with the first directional control valve being assigned to the third position, hydraulic oil is supplied from the second cylinder to the first cylinder, so as to cause the attachment to be tilted more quickly in the forward, direction.

By providing the second directional control valve with a third position, it is also possible to direct hydraulic oil expelled from the first cylinder and the second cylinder to the hydraulic oil supply in a manner so as to cause the lift-arm to be moved up and down in accordance with the undulation of the ground surface, and so as to cause the attachment to be tilted in the forward direction and the rearward direction, during the time that the lift-arm is lowered onto the ground surface.

DETAILED DESCRIPTION OF THE PREFERRED EMBODIMENTS

A first embodiment in which a hydraulic circuit for actuating a materials handling machine according to the invention is applied to an agricultural tractor will be explained below with reference to FIGS. 1 through 7.

Figure 1:
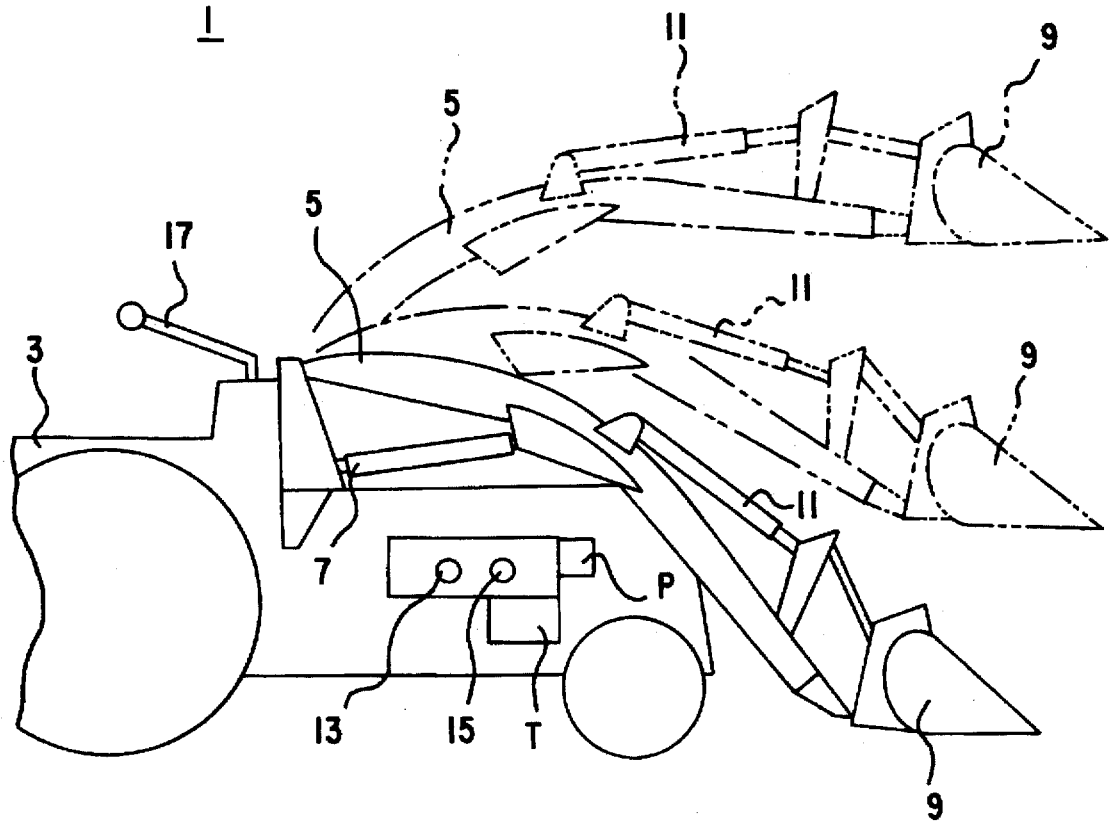
FIG. 1 is a side elevational view generally illustrating an agricultural tractor to which a hydraulic circuit for actuating a materials handling machine according to the invention is applied.
Figure 2:
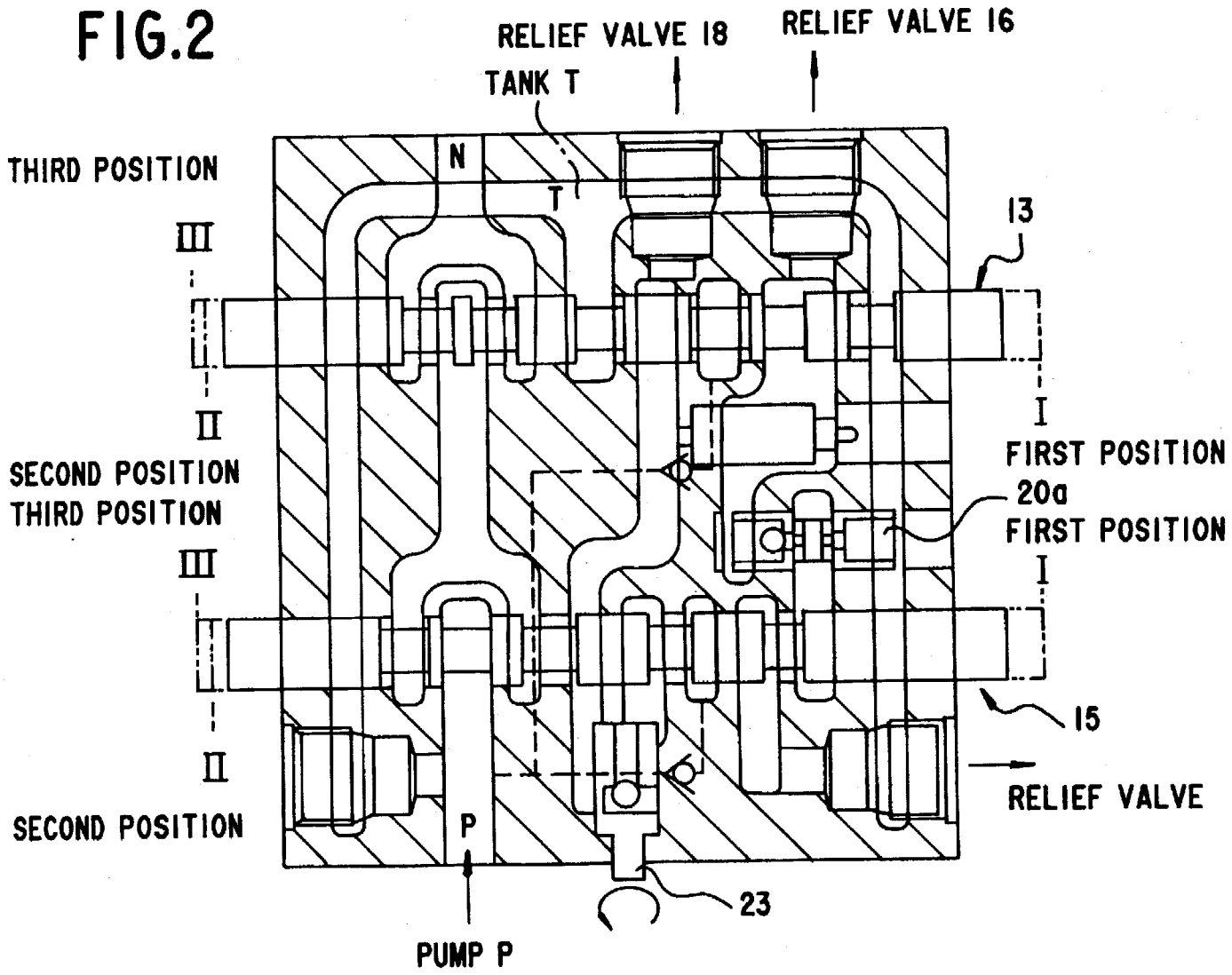
FIG. 2 is an enlarged plan view of a first directional control valve and a second directional control valve constituting the hydraulic circuit for actuating a materials handling machine according to the invention.

The agricultural tractor 1, like conventional one, includes, at the front portion of the vehicle body 3 thereof, a first cylinder 11 for causing a tilting movement of an attachment 9 disposed at the forward end of a lift-arm 5, and a second cylinder 7 for causing a vertical movement, i.e., upward and downward movement, of the lift-arm 5, as shown in FIG. 1. The agricultural tractor also includes, within the vehicle body 3 thereof, a hydraulic oil supply T, and a first directional control valve 13 for primarily controlling the first cylinder 11 for causing a tilting movement of the attachment 9, and a second directional control valve 15 for primarily controlling the second cylinder 7 for causing a vertical movement of the lift-arm 5, as well as a hydraulic oil supply T. The first and second directional control valves are arranged in parallel with each other, as shown in FIGS. 1 and 2. Displacing an operating lever 17 in the upward and downward direction along the arrow mark in FIG. 3 causes the first directional control valve 13 to be actuated to permit vertical movement of the lift-arm 5. Displacing the operating lever 17 in the right-hand and left-hand direction along the arrow mark in FIG. 3 causes the second directional control valve to be actuated to permit tilting movement of the attachment 9.

Figure 3:
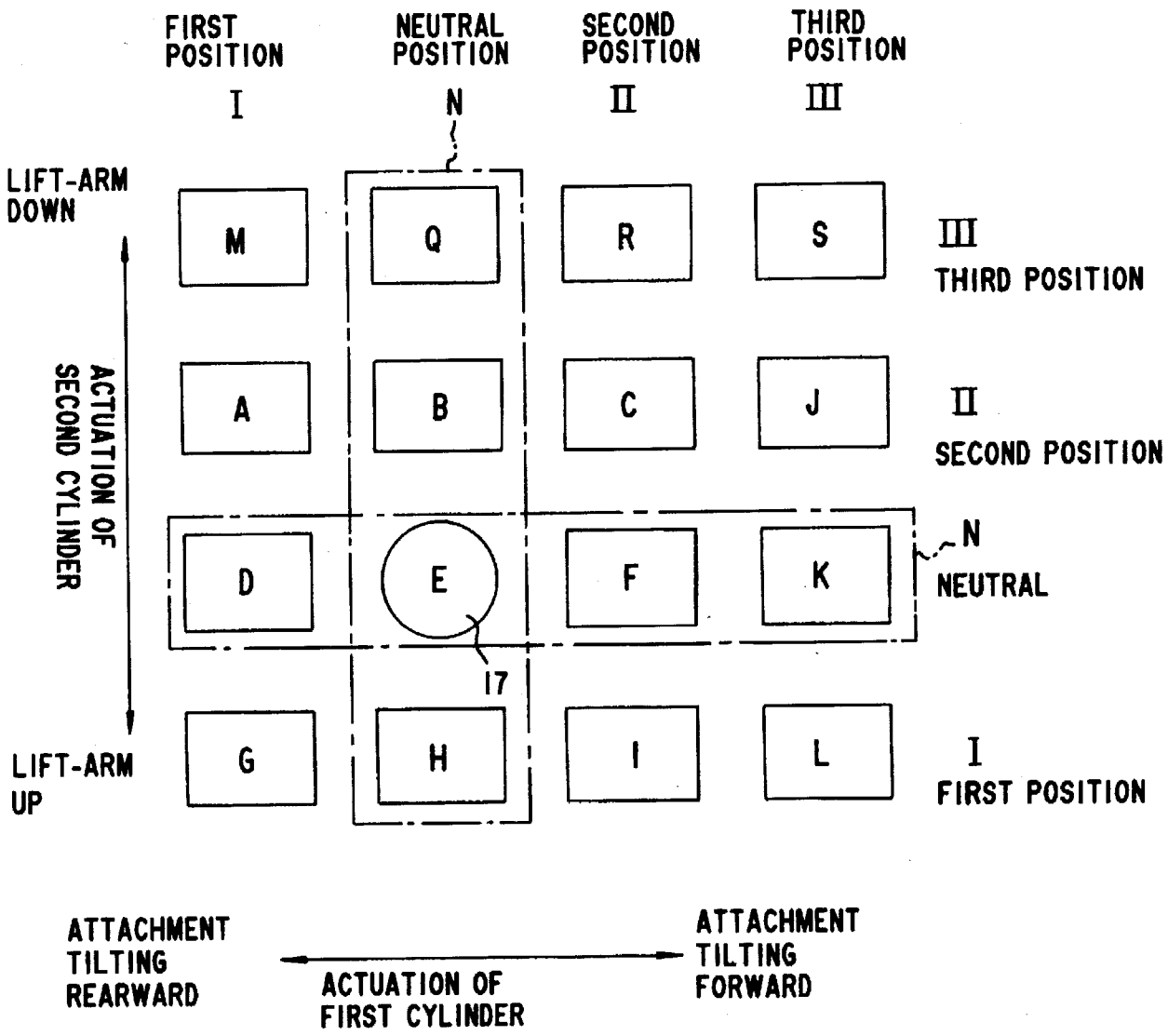
FIG. 3 is an illustrative view showing several positions of an operating lever for controlling the hydraulic circuit for actuating a materials handling machine according to the invention.

Specifically, the first directional control valve 13 is configured so as to selectively direct hydraulic oil from the hydraulic oil supply T to a N-position (neutral position), a first position (right-hand position in FIG. 2), or a second position (left-hand position in FIG. 2). When the operating lever 17 shown in FIGS. 1 and 3 is displaced from E-position (the directional control valve is selected to the N-position) to D-position, the first directional control valve 13 is changed to the first position, so that hydraulic oil is directed into a second chamber 11*b* of the first cylinder, whereby the attachment 9 is tilted in the backward direction. When the operating lever 17 is displaced to F-position, the first directional control valve 13 is changed to the second position, so that hydraulic oil is directed into a first chamber 11*a* of the first cylinder 11, whereby the attachment 9 is tilted in the forward direction.

The second directional control valve 15 is also configured so as to selectively direct hydraulic oil from the hydraulic oil supply T to a N-position (neutral position), a first position (right-hand position in FIG. 2), or a second position (left-hand position in FIG. 2), by displacing the operating lever 17.

When the operating lever 17 shown in FIGS. 1 and 3 is displaced to an H-position, the second directional control valve 15 is changed to the first position, so that hydraulic oil is directed into a first chamber 7*a* of the second cylinder 7, whereby the lift-arm 5 is moved upwardly (raised). When the operating lever 17 is displaced to a B-position, the second directional control valve 15 is changed to the second position, so that hydraulic oil is directed into a first chamber 7*b* of the second cylinder 7, whereby the lift-arm 5 is moved downwardly (lowered).

It is noted that the above change over operation of the first directional control valve 13 and the second directional control valve 15 by means of the operating lever 17 may be performed manually or by means of solenoids (not shown).

Figure 4:
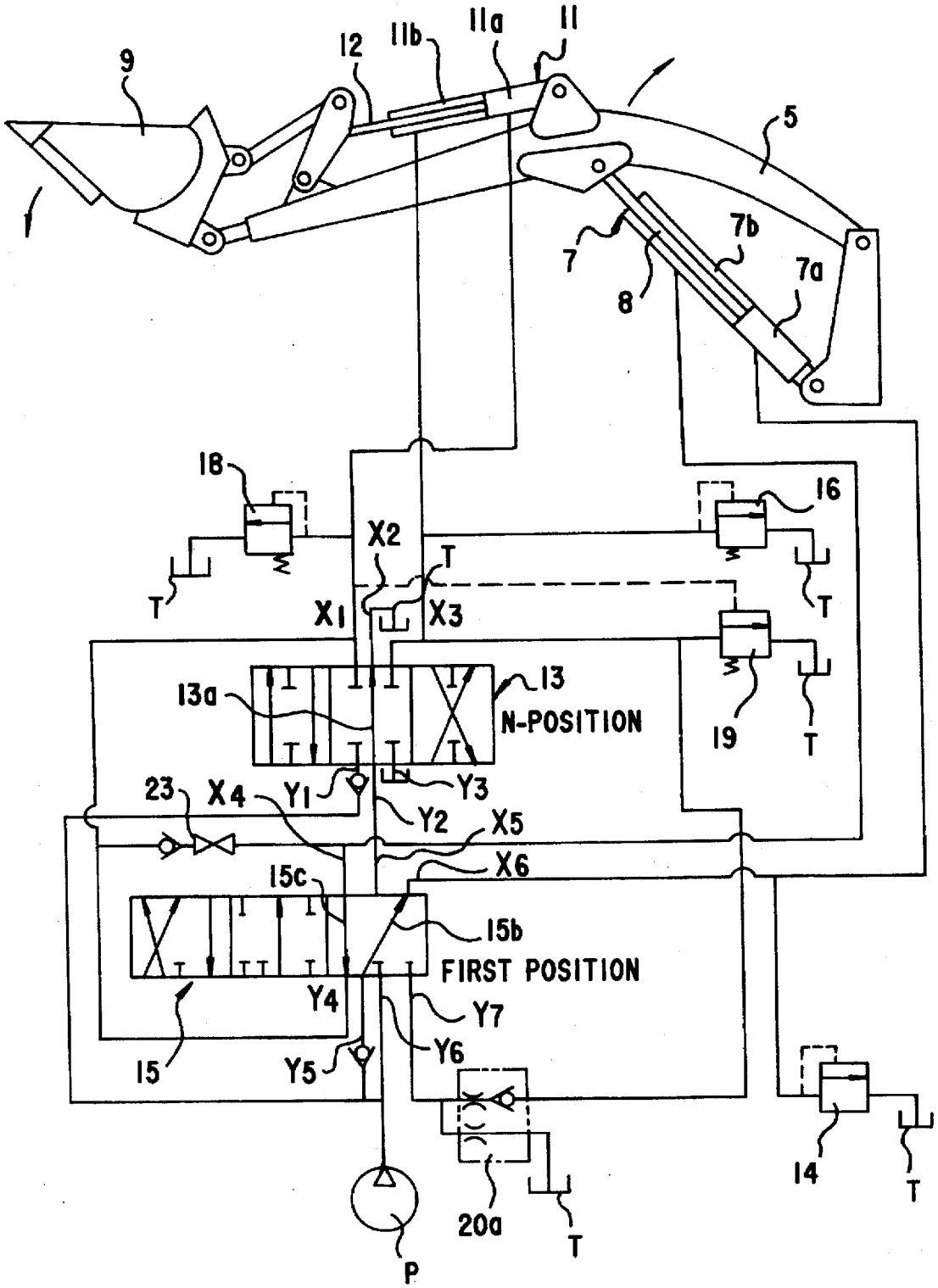
FIG. 4 is a diagrammatic view illustrating the hydraulic circuit for actuating a materials handling machine according to a first embodiment of the invention, wherein the first directional control valve is selected to a N-position (neutral position) and the second directional control valve is selected to a first position.

In addition to the above construction, the hydraulic circuit according the first embodiment is also so configured that, when the second directional control valve 15 is changed to the first position, while the first directional control valve 13 is being assigned or selected to the N-position, hydraulic oil from the second cylinder 7 is appropriately supplied to the first cylinder 11, so as to cause the attachment 9 to be tilted in the forward direction. For example, a pump P and the first chamber 7*a* of the second cylinder 7 are connected with each other by means of an outgoing passage 15*b* of the second directional control valve 15, while the second chamber 7*b* of the second cylinder 7 and the first chamber 11*a* of the first cylinder 11 are connected with each other by means of a return passage 15*c*, as shown in FIG. 4. The hydraulic oil discharged from the second chamber 11*b* of the first cylinder 11 is returned to the hydraulic oil supply T through a brake valve 19.

Figure 5:
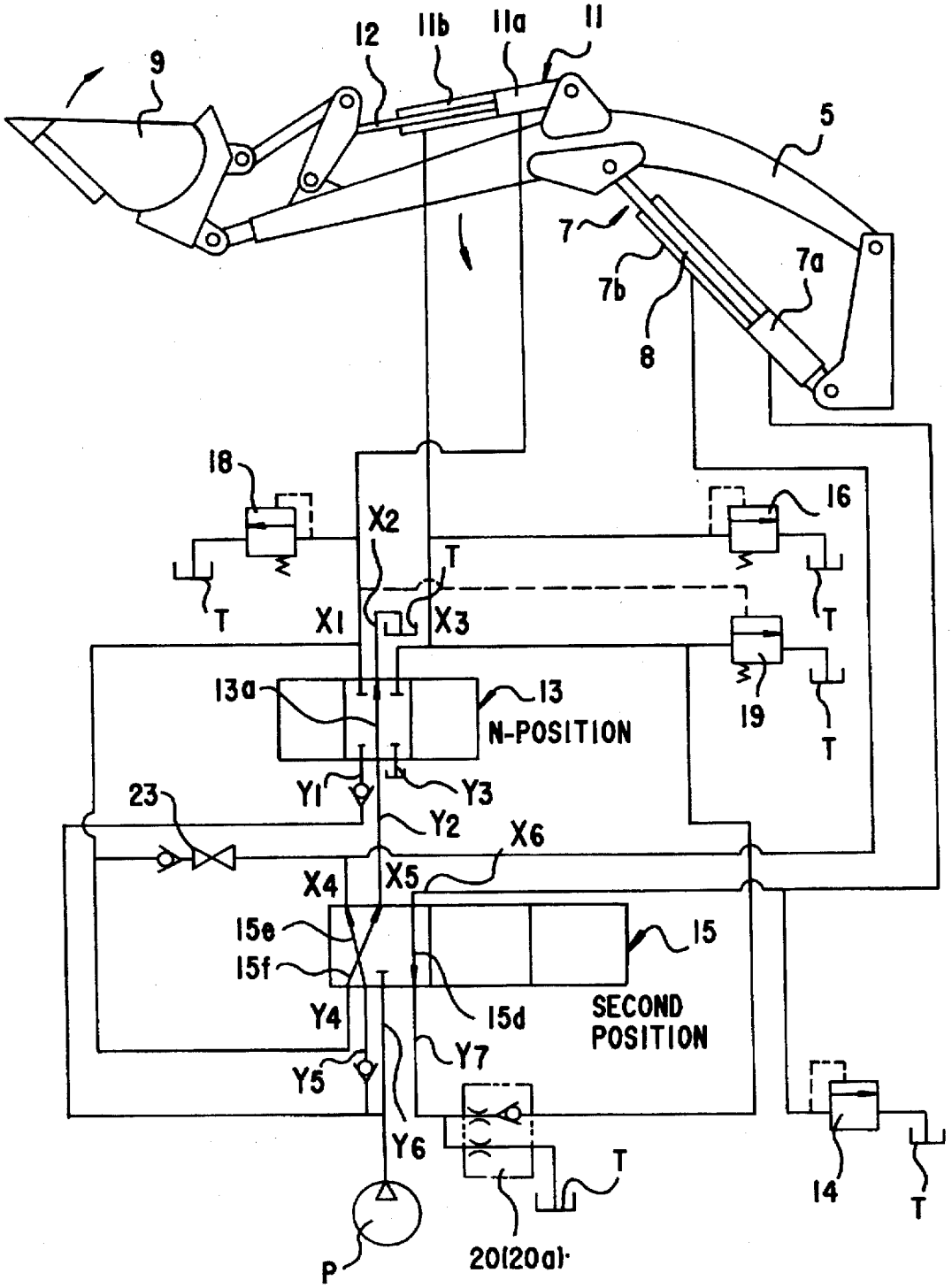
FIG. 5 is a diagrammatic view illustrating the hydraulic circuit for actuating a materials handling machine according to the first embodiment of the invention, herein the first directional control valve is selected to a N-position and the second directional control valve is selected to a second position.

Further, the hydraulic circuit is so configured that, when the second directional control valve 15 is changed to the second position, while the first directional control valve 13 is being assigned to the N-position, the hydraulic oil from the second cylinder 7 is appropriately supplied to the first cylinder 11 so as to cause the attachment 9 to be tilted in the rearward direction. For example, the pump P and the second chamber 7*b* of the second cylinder 7 are connected with each other through an outgoing passage 15*e* of the second directional control valve 15, while the first chamber 7*a* of the second cylinder 7 and the second chamber 11*b* of the first cylinder 11 are connected with each other through a return passage 15*d*, as shown in FIG. 5. The first chamber 11*a* of the first cylinder 11 and the hydraulic oil supply T are connected with each other through an outgoing passage 15*f*.

The embodiment further includes a means 20 for dividing and restricting the quantity of hydraulic oil flowing from the second cylinder 7 to the first cylinder 11 (flow divider/restrictor means) in accordance with alteration in height of the lift-arm 5, whereby the attachment 9 secured to the forward end of the lift-arm 5 may be always kept at a constant angle with respect to the surface of the ground. For example, in the above case wherein the second directional control valve 15 is changed to the second position, while the first directional control valve 13 is being assigned to the N-position as in the above case (see FIG. 5), a flow dividing valve 20*a* is disposed between the return passage 15*d* and the second chamber 11*b* of the first cylinder 11. It is to be noted that an inclination sensor (not shown) may be secured to the attachment. In such a case, the flow divider/restrictor means 20 may include a variable flow divider provided with a microcomputer for regulating a divided flow rate of the hydraulic oil in accordance with a given angle of inclination from the inclination sensor. In the drawings, reference numerals 14, 16 and 18 designate relief valves, and reference numerals X1 to X6 and Y1 to Y7 designate ports.

With the above construction in mind, explanation will be given below as to how the lift-arm 5 and the attachment 9 at the forward end thereof are actuated when the operating lever 17 shown in FIG. 17 is shifted to E, D, B, F or H position.

When the operating lever 17 is shifted to E-position the first directional control valve 13 and the second directional control valve 15 are both assigned to neutral position (see FIGS. 2 and 3). Both of the first cylinder 11 and the second cylinder 7 are not actuated. Thus, the lift-arm 5 and the attachment 9 are held in a respective basic posture or position.

Figure 6:
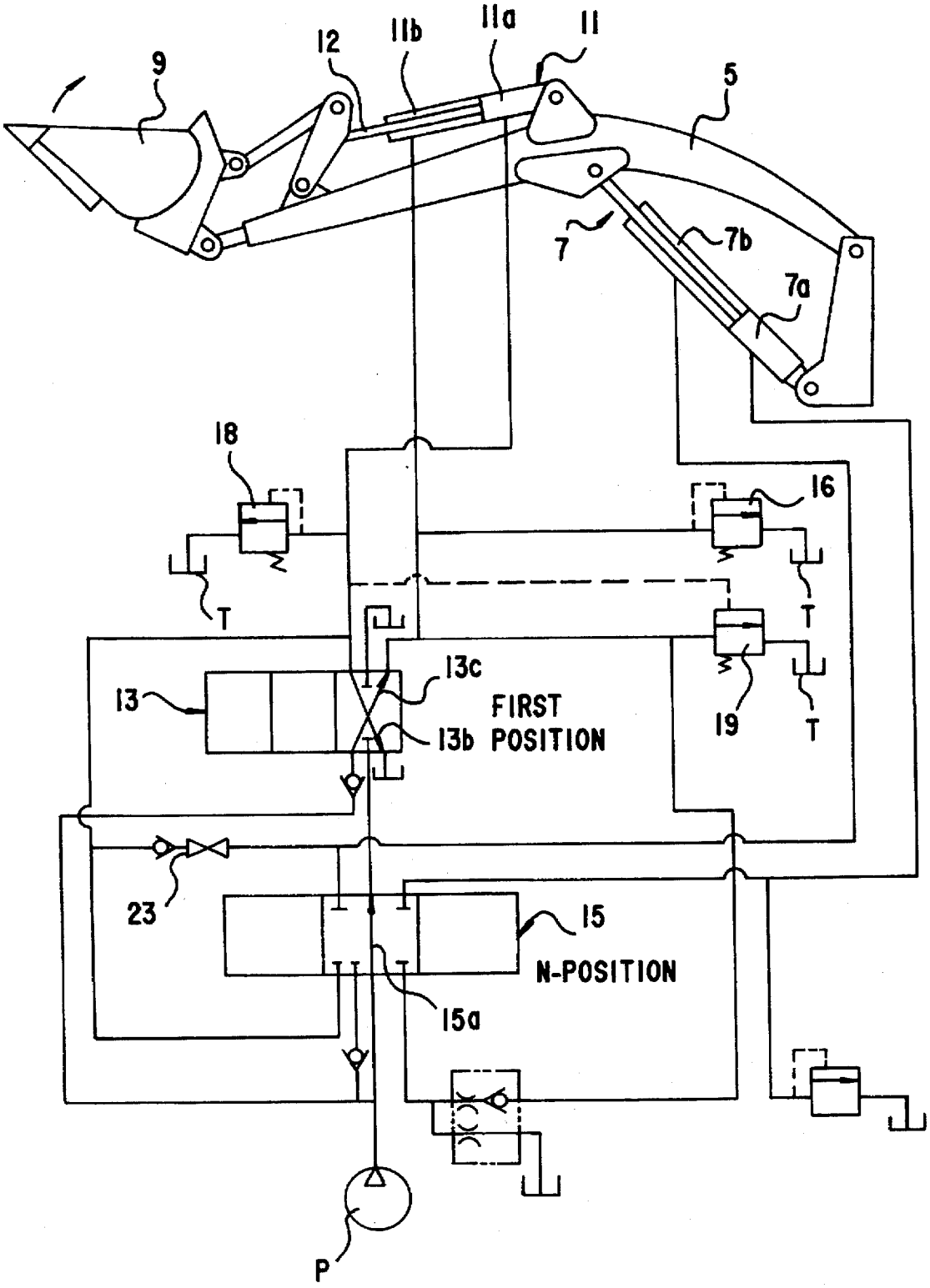
FIG. 6 is a diagrammatic view illustrating the hydraulic circuit for actuating a materials handling machine according to the first embodiment of the invention, wherein the first directional control valve is selected to a first position and the second directional control valve is selected to a N-position.
Figure 7:
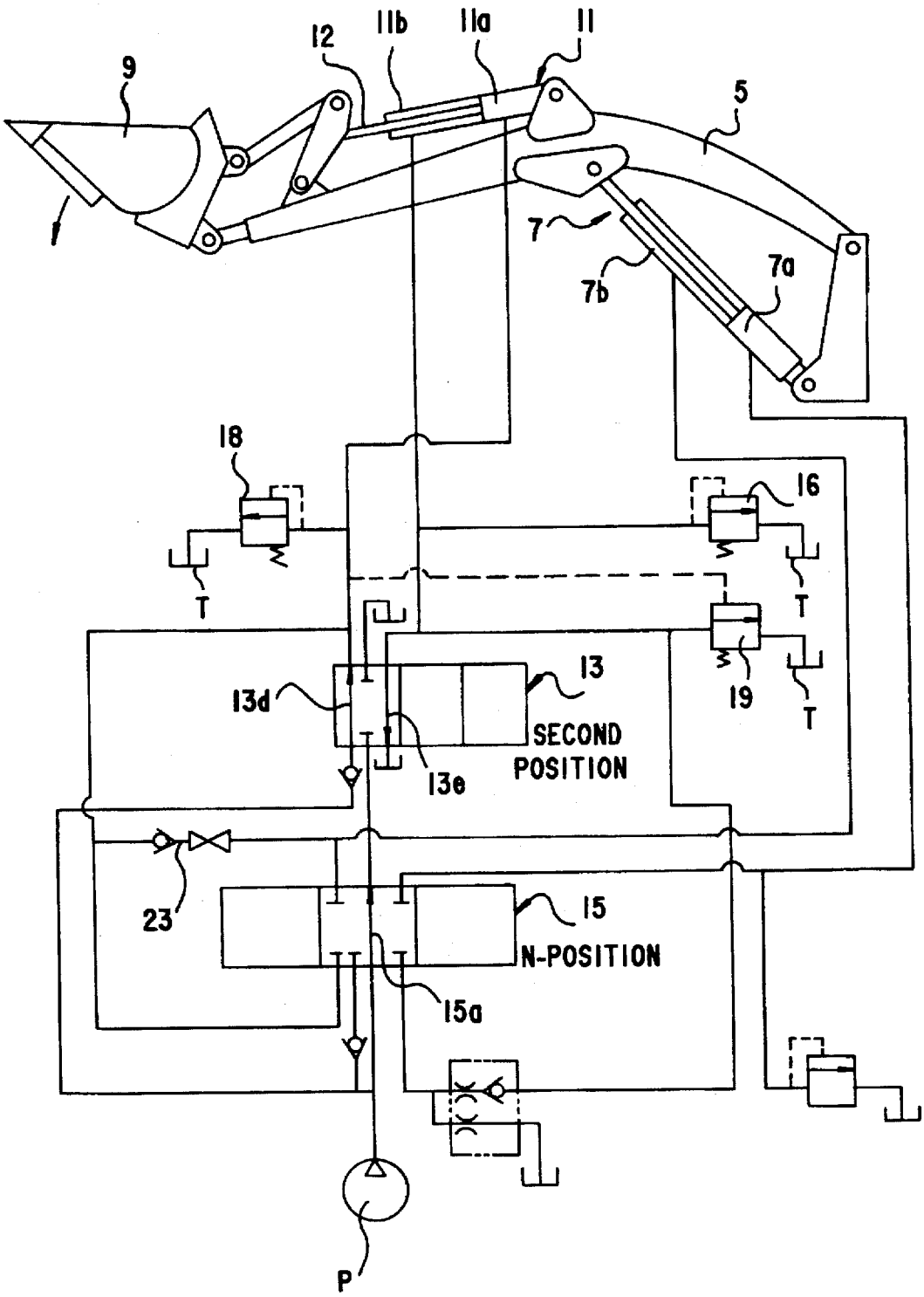
FIG. 7 is a diagrammatic view illustrating the hydraulic circuit for actuating a materials handling machine according to the first embodiment of the invention, wherein the first directional control valve is selected to a second position and the second directional control valve is selected to a N-position.

When the operating lever 17 is shifted to D-position shown in FIG. 3, hydraulic oil supplied from the pump P to the outgoing passage 13*c* of the directional control valve 13 is supplied to the second chamber 11*b* of the first cylinder 11. This causes retraction or contraction of a rod 12, whereby the attachment 9 is tilted in the rearward direction, as shown in FIG. 6. When the operating lever 17 is shifted to F-position shown in FIG. 3, the hydraulic oil supplied from the pump P to the outgoing passage 13*d* of the first directional control valve 13 is supplied to the first chamber 11*a* of the first cylinder 11. This causes extension or expansion of the rod whereby the attachment 9 is tilted in the forward direction, as shown in FIG. 7.

When the operating lever 17 is shifted to H-position shown in FIG. 3, the hydraulic oil supplied from the pump P to the outgoing passage 15*b* of the second directional control valve 15 is supplied to the first chamber 7*a* of the second cylinder 7. This causes extension of a rod 8, whereby the lift-arm 5 is moved upwardly, as shown in FIG. 4. As the lift-arm 5 is moved upwardly, the hydraulic oil expelled from the second chamber 7*b* of the second cylinder 7 is directed through the return passage 15*c* of the second directional control valve 15 into the first chamber 11*a* of the first cylinder 11. This causes extension of the rod 12 of the first cylinder 11, whereby the attachment 9 at the forward end of the lift-arm 5 is tilted in the forward direction. In accordance with the extension of the rod 12 and the tilting movement of the attachment 9, the hydraulic oil expelled from the second chamber 11*b* of the first cylinder 11 is returned to the hydraulic oil supply T through the brake valve 19. This serves to prevent the attachment 9 at the forward end of the lift-arm to be suddenly tilted in the forward direction, due to an external force from a load, for example. As the result, the attachment 9 is gradually tilted in the forward direction depending upon the degree of upward movement of the lift-arm 5, so that the attachment 9 may be always kept at a constant angle relative to the surface of the ground.

When the operating lever 17 is shifted to B-position shown in FIG. 3, the hydraulic oil supplied from the pump P to the outgoing passage 15*e* of the second directional control valve 15 is supplied to the second chamber 7*b* of the second cylinder 7. This causes retraction of the rod 8, whereby the lift-arm 5 is lowered, as shown in FIG. 5. As the rod 8 is retracted and the lift-arm 5 is lowered, the hydraulic oil expelled from the first chamber 7*a* of the second cylinder 7 is directed through the return passage 15*d* of the second directional control valve 15 into the second chamber 11*b* of the first cylinder 11. This causes retraction of the rod 12 of the first cylinder 11, whereby the attachment 9 is tilted in the rearward direction. As the rod 12 is retracted and the attachment 9 is tilted, the hydraulic oil expelled from the first chamber 11*a* of the first cylinder 11 is directed through the return passage 15*f* of the second directional control valve 15 and the outgoing passage 13*a* of the first directional control valve 13 to the hydraulic oil supply T. At this time, the hydraulic oil is divided at a constant rate, by means of a flow dividing valve 20*a* disposed between the return passage 15*d* of the second directional control valve 15 and the second chamber 11*b* of the first cylinder, to be directed into the second chamber 11*b* (reduced in its volume) of the first cylinder 11. Thus, it is possible for the attachment 9 at the forward end of the lift-arm 5 to be gradually tilted in the rearward direction. As the result, the attachment 9 is gradually tilted in the rearward direction in accordance with the degree of downward movement of the lift-arm 5, so that the attachment may be kept at a constant angle with respect to the surface of the ground.

As will be appreciated from the foregoing, it is advantageous in accordance with the first embodiment of the invention that the lift-arm 5 may be raised and lowered, while always keeping the attachment 9 at the forward end of the lift-arm 5 at a constant angle with respect to the surface of the ground, by shifting the operating lever 17 to B-position or H-position shown in FIG. 3 so as to only actuate the second directional control valve 15, without actuating the first directional control valve 13 at all.

It should be noted that the operating lever 17 may be set at any desired position of combination of each of B, H, D and F-positions. For example, the lift-arm 5 may be lowered, while, at the same time, the attachment 9 is tilted in the rearward direction, when the operating lever 17 is shifted to A-position. It is also possible for the lift-arm 5 to be raised, while the attachment 9 is being tilted in the forward direction, when the operating lever 17 is shifted to I-position. Further, it is possible for the lift-arm 5 to be lowered, while the attachment 9 is being tilted in the forward direction, when the operating lever 17 is shifted to C-position. Furthermore, it is possible for the lift-arm 5 to be raised, while the attachment 9 is being tilted in the rearward direction, when the operating lever 17 is shifted to the G-position.

Next, operation of an open-close valve 23, disposed between the outgoing passage 15*e* of the second directional control valve 15 and the first chamber 11*a* of the first directional control valve 13, will be explained. The open-close valve 23 may be opened by rotating it 180 degrees. With the open-close valve 23 being opened, the hydraulic oil from the first chamber 11*a* of the first cylinder 11 may be directed through the outgoing passage 15*f* of the second directional control valve 15 and the outgoing passage 13*a* of the first directional control valve 13 back to the hydraulic oil supply T, after the lift-arm 5 has been lowered onto the surface of the ground by shifting the operating lever 17 to B-position shown in FIG. 3 (see FIG. 5). It is also possible to direct the hydraulic oil from the first chamber 7*a* of the second cylinder 7 through the flow dividing valve 20*a* into the second chamber 11*b* of the first cylinder 11. Contrariwise, it is possible to direct the hydraulic oil from the pump P through the outgoing passage 15*e* and the open-close valve 23 directly to the first chamber 11*a* of the first cylinder 11. Thus, the attachment 9 may be tilted in the forward direction or rearward direction, depending upon undulation in the surface of the ground.

It will be appreciated that the lift-arm 5 is gradually lowered substantially by its own weight, since the hydraulic oil from the first chamber 7*a* of the second cylinder 7 is returned to the hydraulic oil supply T through the flow dividing valve 20*a*. Thus, the attachment 9 is appropriately tilted depending upon undulation in the surface of the ground and, at the same time, the lift-arm 5 is slightly moved up and down, when the lift-arm 5 is lowered to cause the attachment 9 to be in contact with the surface of the ground. Accordingly, floating works such as grass gathering, ground leveling, or the like may be advantageously performed, without damaging the ground surface.

Figure 8:
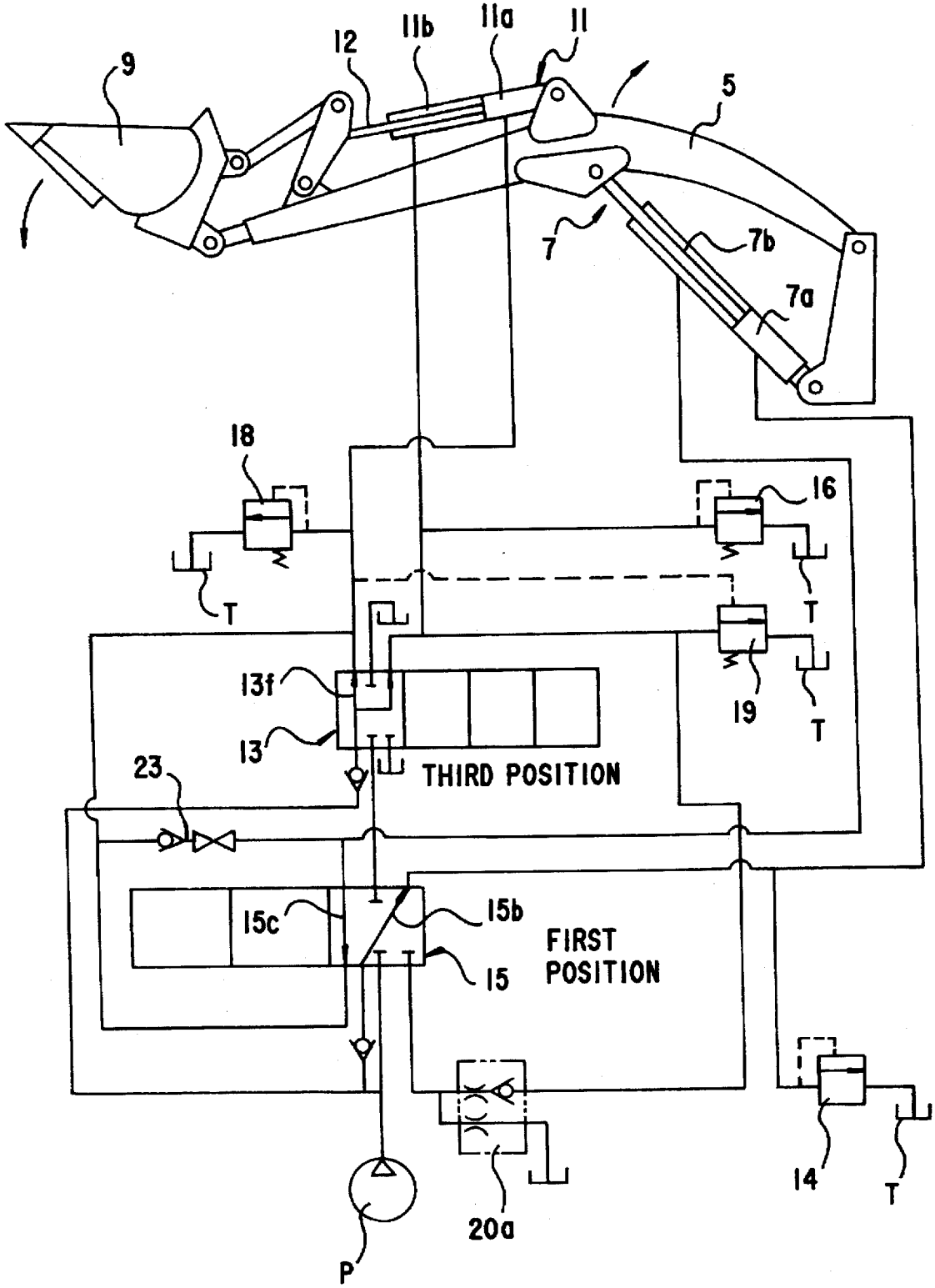
FIG. 8 is a diagrammatic view illustrating the hydraulic circuit for actuating a materials handling machine according to a second embodiment of the invention, wherein the first directional control valve is selected to a third position and the second directional control valve is selected to a first position.

A second embodiment of the invention will be explained with reference to FIG. 8, wherein the hydraulic oil from the hydraulic oil supply T may be selectively directed not only to the above N-position (neutral position), the first position and the second position, but also to a third position.

In accordance with the second embodiment, the hydraulic circuit extending from the second directional control valve 15 and the second cylinder 7 to the first cylinder 11 is so configured that the hydraulic oil expelled from the second cylinder 7, when the second directional control valve 15 is changed to the first position and the second position, with the first directional control valve 13 being assigned to the third position, is supplied to the fist cylinder 11, so as to cause the attachment 9 to be more quickly tilted in the forward direction. For example, the pump P and the first chamber 11*a* of the first cylinder 11 are connected with each other through the outgoing passage 13*f* of the first directional control valve 13, and the second chamber 7*b* of the first cylinder 7 and the first chamber 11*a* of the first cylinder are connected with each other through the outgoing passage 15*c* of the second directional control valve 15., as shown in FIG. 8. Due to such connections, the hydraulic oil supplied from the pump P is directed through the outgoing passage 13*f* of the first directional control valve 13 to the first chamber 11*a* of the first cylinder 11, while the hydraulic oil expelled from the second chamber 7*b* of the first cylinder 7 is directed to the first chamber 11*a* of the first cylinder 11. This causes even more quick extension of the rod 12 of the first cylinder 11, whereby the attachment 9 may be quickly tilted in the forward direction. Hydraulic oil is also supplied directly to the first chamber 7*a* of the second cylinder 7 through the outgoing passage 15*b* of the second directional control valve 15, so that the lift-arm 5 may be quickly raised. Alternatively, when the first directional control valve 13 is assigned to the third position and the second directional control valve 15 is assigned to the second position (not shown), it is also possible for the attachment 9 to be quickly tilted in the forward direction like the above case. It is noted, however, that the lift-arm 5 is slowly lowered at a usual speed, due to the operation of the flow dividing valve 20*a*. Thus, when a bucket 9, for example, is used as the attachment , it is advantageously possible to shake soil and sand or compost in the bucket 9 off in a quick and safe manner.

Figure 9:
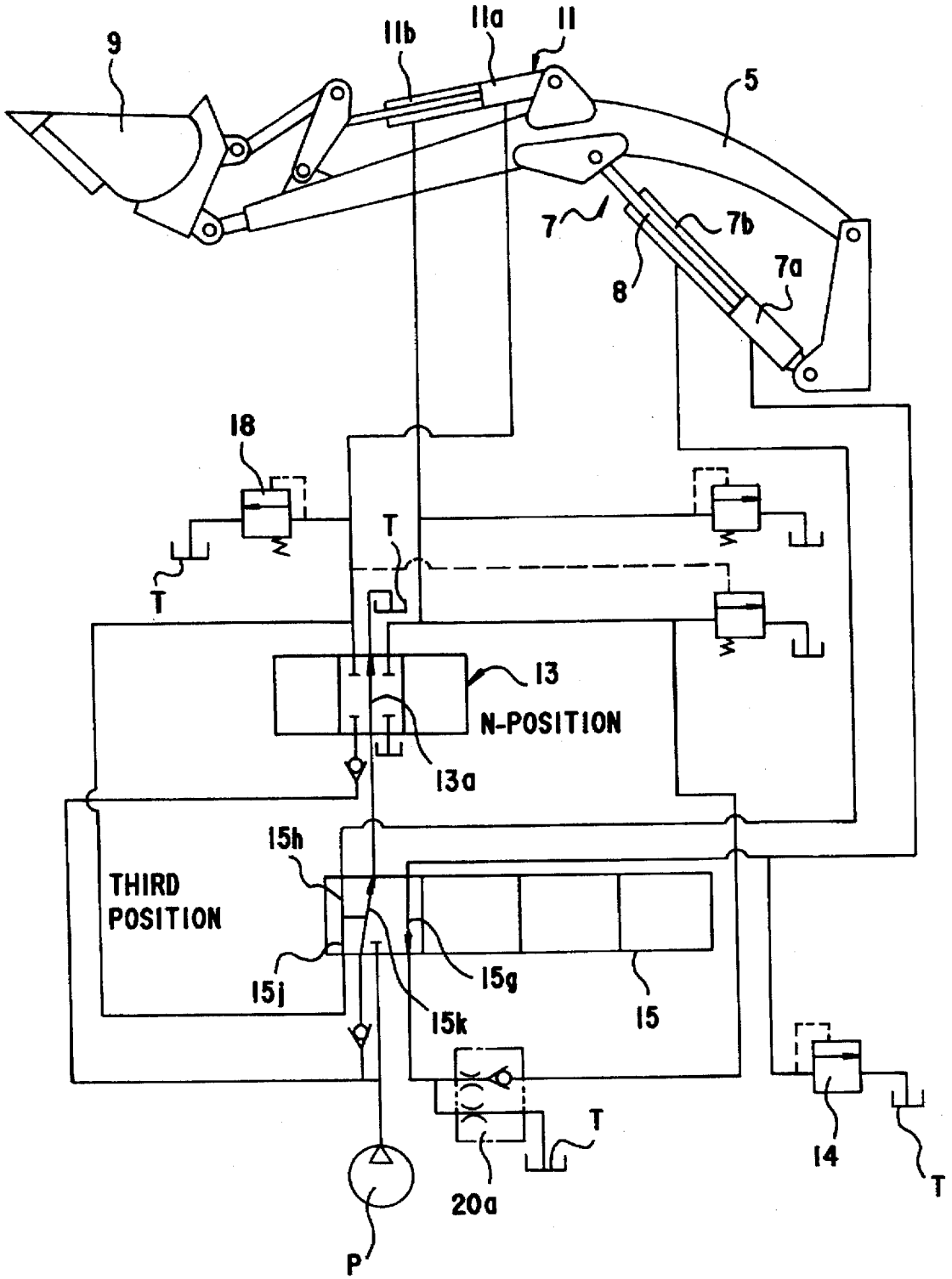
FIG. 9 a diagrammatic view illustrating the hydraulic circuit for actuating a materials handling machine according to a third embodiment of the invention, wherein the first directional control valve is selected to a N-position and the second directional control valve is selected to a third position.
Figure 10:
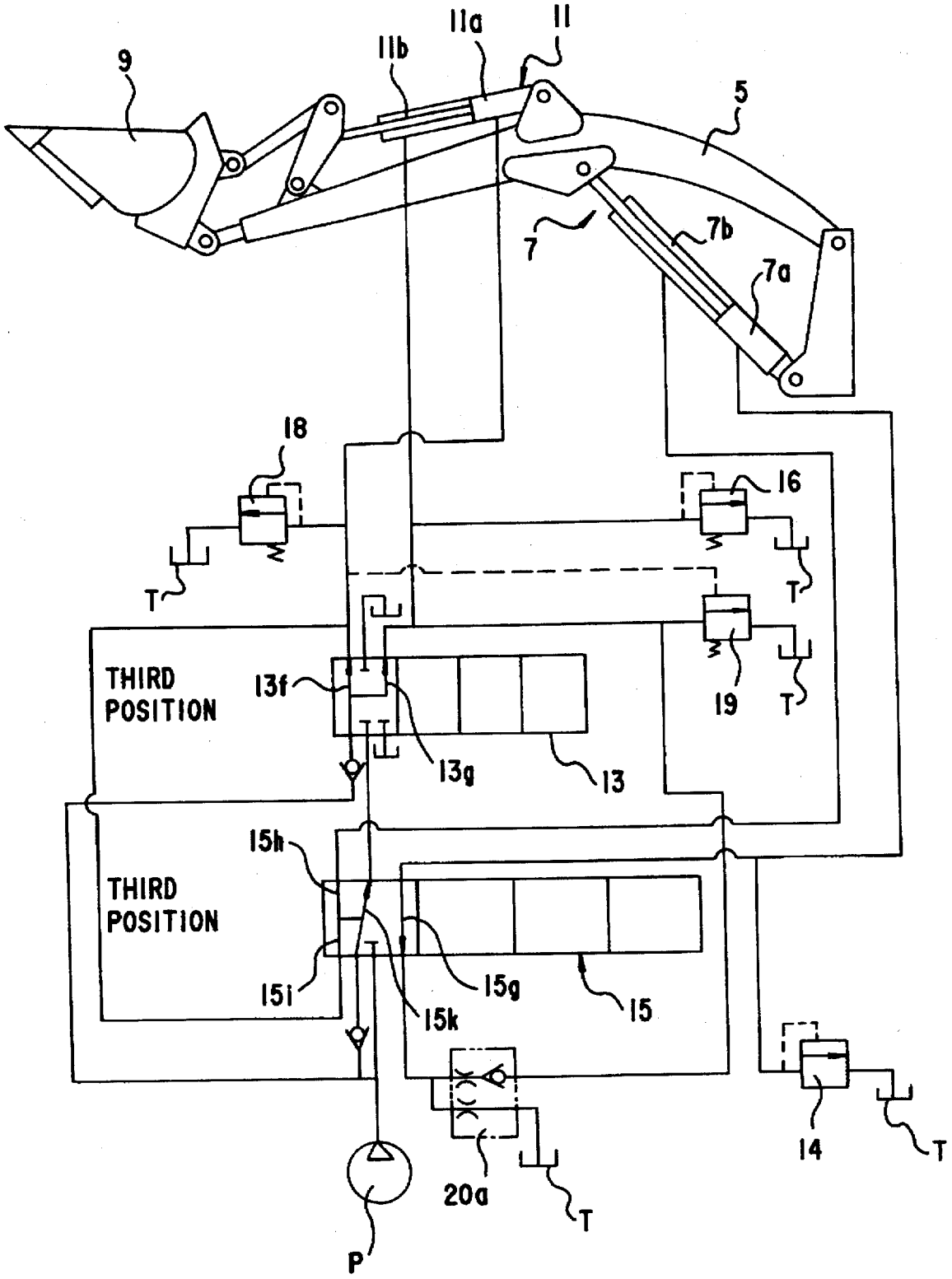
FIG. 10 a diagrammatic view illustrating the hydraulic circuit for actuating a materials handling machine according to a fourth embodiment of the invention, wherein the first directional control valve is selected to a third position and the second directional control valve is also selected to a third position.
Figure 11:
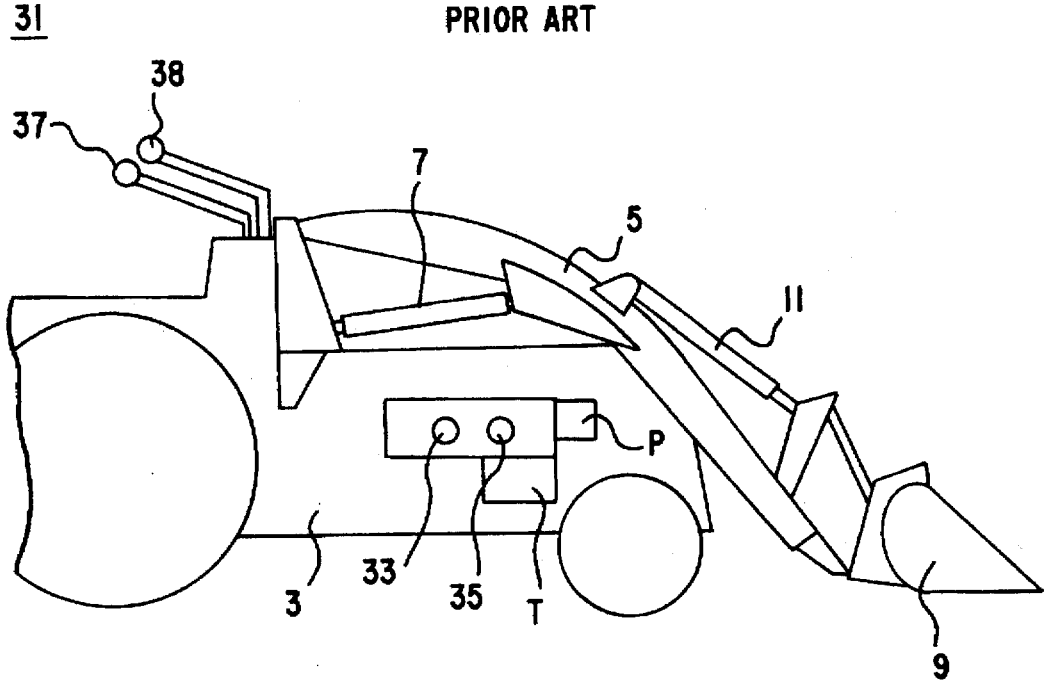
FIG.11 PRIOR ART
FIG. 11 is a side elevations view generally illustrating an agricultural tractor mounted with a conventional hydraulic circuit for actuating a materials handling machine.
Figure 12:
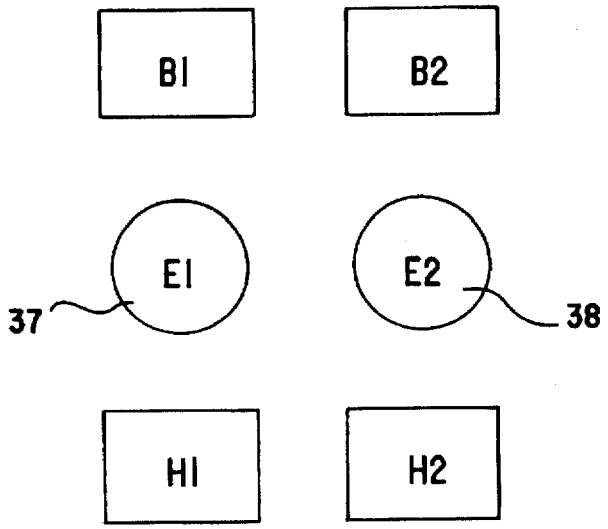
FIG.12 PRIOR ART
FIG. 12 is an illustrative view showing several positions of an operating lever for controlling a hydraulic circuit for actuating a materials handling machine according to prior art.

Next, a hydraulic circuit according to a third embodiment of the invention, wherein the above function of the open-close valve 23 is incorporated into the second directional control valve 15, will be explained with reference to FIG. 9. The hydraulic circuit is so configured that, when the lift-arm 5 is lowered onto the ground surface, the lift-arm 5 may be raised or lowered depending upon undulation of the ground surface, without actuating the open-close valve 23, and the inclination angle of the attachment 9 may be also varied.

In accordance with the third embodiment of the invention, a third position is added to the second directional control valve 15, so as to constitute the hydraulic circuit extending from the second directional control valve 15 and the second cylinder 7 to the first cylinder 11. Consequently, the hydraulic circuit is so configured that the hydraulic oil expelled from the second cylinder 7 and the hydraulic oil expelled from the first cylinder 11 are both returned to the hydraulic oil supply T. For example, when the first directional control valve 13 is assigned to N-position and the second directional control valve 15 is assigned to the third position, the first chamber 7*a* of the second cylinder 7 and the flow dividing valve 20*a* are connected to the hydraulic oil supply T through the return passage 15*g* of the second directional control valve 15, as well as to the second chamber 11*b* of the first cylinder 11, as shown in FIG. 9. The first chamber 11*a* of the first cylinder 11 and the second chamber 7*b* of the second cylinder 7 are also, connected with each other through a connection passages 15*h* and 15*j* of the second directional control valve 15.

In accordance with the third embodiment, when the operating lever 17 is shifted to Q-position shown in FIG. 3, the rod 8 is retracted due to the weight of the lift-arm 5. Thus, a portion of the hydraulic oil from the first chamber 7*a* of the second cylinder 7 is returned through the return passage 15*g* of the second directional control valve 15 to the hydraulic oil supply T, while, at the same time, the remaining hydraulic oil is directed to the second chamber 11*b* of the first cylinder 11, so as to cause the attachment 9 to be tilted in the rearward direction. The hydraulic oil from the first chamber 11*a* of the first cylinder 11 is directed, through the connection passage 15*j* and the return passage 15*k*, to the second chamber 7*b* of the second cylinder 7 and the hydraulic oil supply T, respectively.

Accordingly, the lift-arm 5 is lowered onto the ground surface by reason of its own weight, while the attachment 9 is tilted in the rearward direction so as to be kept at a constant angle which is substantially horizontal with respect to the ground surface. Once the attachment 9 has come into contact with the ground surface. the lift-arm 5 is advantageously moved slightly up or down depending upon the undulation of the ground surface, without opening the open-close valve 23 incorporated in the first embodiment, while the attachment 9 is also tilted in the forward direction or the rearward direction along the undulation of the ground surface.

When the operating lever 17 is shifted to M-position shown in FIG. 3, the first directional control valve is assigned to the first position and the second directional control valve is assigned to the third position, whereby the lift-arm 5 is lowered in the manner similar to the above by reason of its own weight. A portion of the hydraulic oil expelled from the first chamber 7*a* of the second cylinder 7 is directed through the return passage 15*g* of the second directional control valve 15 and the flow dividing valve 20*a* to the hydraulic oil supply T, and the remaining hydraulic oil from the first chamber 7*a* is directed to the second chamber 11*b* of the first cylinder 11. At the same time, hydraulic oil is supplied from the pump P, through the outgoing passage 13*c* of the first directional control valve 13, to the second chamber 11*b* of the first cylinder 11, whereby the attachment 9 is further tilted in the rearward direction. Is the result, it is possible for the attachment 9 to be further tilted in the rearward direction from its horizontal position, while the lift-arm 5 is being lowered slowly. Once the attachment 9 has come into contact with the ground surface, the lift-arm 5 is moved slightly up or down along the undulation of the ground surface, while, at the same time, the attachment is also tilted in the forward direction or the rearward direction depending upon the undulation of the ground surface.

When the operating lever 17 is shifted to R-position shown in FIG. 3, the first directional control valve 13 and the second directional control valve 15 are assigned to the second position and the third position, respectively, whereby the lift-arm 5, like the above case, is lowered substantially by reason of its own weight. At the same time, hydraulic oil supplied from the pump P is directed through the outgoing passage 13*d* of the first directional control valve 13 to the first chamber 11*a* of the first cylinder 11, whereby the attachment 9 is tilted in the forward direction. As the result, the attachment 9 is permitted to be tilted in the forward direction from its horizontal position, while the lift-arm 5 is being gradually lowered. Once the attachment 9 has come into contact with the ground surface, the lift-arm 5 is moved slightly up and down along the undulation of the ground surface, while, at the same time, the attachment 9 is tilted in the forward direction or the rearward direction along the undulation of the ground surface.

As will be appreciated from the foregoing, the attachment 9 at the forward end of the lift-arm 5 may be advantageously tilted in the forward direction the rearward direction, while the lift-arm 5 is in the lowered position. It is also possible for the attachment 9 and the lift-arm 5 to advantageously follow the undulation of the ground surface.

In the above embodiments, the attachment 9 is tilted in the forward and rearward directions, respectively, by means of the extension and contraction of the first cylinder 11, and the lift-arm 5 is moved upwardly and downwardly, respectively, by means of the extension and contraction of the second cylinder 7. It is noted, however, that, on the contrary to the above, the attachment 9 may be tilted in the rearward and forward directions, respectively, be means of the extension and contraction of the first cylinder 11, and the lift-arm 5 may be moved downwardly and upwardly, respectively, by means of the extension and contraction of the second cylinder 7. In such a case, the above hydraulic circuit is appropriately modified.

Advantages of the Invention

As will be appreciated from the foregoing, the first and second cylinders may be separately controlled, while, at the same time, the first directional control valve may be simultaneously controlled by only actuating the second directional control valve, in accordance with the hydraulic circuit for actuating a materials handling machine of the invention.

Specifically, each of the first and second directional control valves may be shifted to each of the three positions, i.e., the N-position, the first position, the second position, so that nine control patterns in total may be surely performed. In particular, the lift-arm may be raised and lowered while maintaining the attachment at a constant angle with respect to the ground surface, by simply actuating the second directional control valve, with the first directional control valve being kept in its neutral position.

Since the first directional control valve is provided with a third position, the first directional control valve may be shifted between four positions, i.e., N-position, the first position, the second position and the third position, whereby twelve control patterns in total, in combination with the second directional control valve, may be surely performed. When the first directional control valve is assigned to the third position, it is possible for the first cylinder for tilting movement of the attachment to be quickly extended, when specifically desired, so as to cause the attachment to be forcibly tilted in the forward direction. It is also possible for the lift-arm to be quickly moved upwardly, while, at the same time, causing the attachment to be quickly tilted in the forward direction.

By combining the first directional control valve, shiftable between the N-position, the first position and the second position, with the second directional control valve having an additional function of a conventional open-close valve, due to the fact that it is also shiftable to a third position, it is possible for the attachment to be tilted in the forward or rearward direction along the ground surface, when the lift-arm is lowered. It is also possible for the attachment to be advantageously maintained at its horizontal position with respect to the ground surface, so that grass gathering or ground leveling may be performed without damaging the ground surface.

We claim:

1. A hydraulic circuit for actuating a materials handling machine in which:

hydraulic oil from a hydraulic oil supply is directed, through a first directional control valve shiftable between an N-position (neutral position), and a first position and a second position, to a first cylinder for tilting an attachment, so as to cause the attachment to be tilted in the rearward direction, when the first directional control valve is assigned to the first position, and so as to cause the attachment to be tilted in the forward direction, when the first directional control valve is assigned to the second position;

hydraulic oil from the hydraulic oil supply is directed, through a second directional control valve shiftable between an N-position, and a first position and a second position, to a second cylinder for raising and lowering a pivotable lift-arm carrying the attachment at the forward end thereof, so as to raise the lift-arm when the second directional control valve is assigned to the first position, and so as to lower the lift-arm when the second directional control valve is assigned to the second position; characterized by:

with said first directional control valve being assigned to said N-position;

a hydraulic circuit extending from said second directional control valve and said second cylinder to said first cylinder is so configured that, when said second directional control valve is assigned to said first position, hydraulic oil expelled from said second cylinder is supplied to said first cylinder in a manner so as to cause said attachment to be tilted in the forward direction, and that, when said second directional control valve is assigned to said second position, hydraulic oil from said second cylinder is supplied to said first cylinder in a manner so as to cause said attachment to be-tilted in the rearward direction;

the hydraulic circuit for actuating a materials handling machine further including:

a hydraulic oil divider/restrictor means for regulating a quantity of hydraulic oil flowing from said second cylinder to said first cylinder, whereby said attachment is kept at a substantially constant angle with respect to the ground surface in accordance with a displacement (variation) in height of said lift-arm;

said first directional control valve is shiftable to an additional third position thereof:

with said first directional control valve being assigned to said third position, said hydraulic circuit extending from said second directional control valve and said second cylinder to said first cylinder is so configured that, when said second directional control valve is assigned either to said first or second positions, hydraulic oil expelled from said second cylinder is supplied to said first cylinder in a manner so as to cause said attachment to be tilted more quickly in the forward direction.

2. A hydraulic circuit for actuating a materials handling machine according to claim 1, wherein:

said directional control valve is shiftable to an additional position thereof;

with said second directional control valve being assigned to said third position, said hydraulic circuit extending from said second directional control valve and said second cylinder to said first cylinder is so configured that, once said lift-arm has been lowered onto the ground surface, said lift-arm may be moved up and down and the inclination angle of said attachment may be varied in accordance with the undulation of the ground surface.

* * * * *